US005375723A

United States Patent [19]

Kelley

[11] Patent Number: 5,375,723

[45] Date of Patent: Dec. 27, 1994

[54] HEADER AND PANEL HANGING SYSTEM

[75] Inventor: James O. Kelley, Spring Lake, Mich.

[73] Assignee: Nevers Industries, Inc., Minneapolis, Minn.

[21] Appl. No.: 115,907

[22] Filed: Sep. 1, 1993

[51] Int. Cl.[5] ..... A47F 5/00

[52] U.S. Cl. ..... 211/1.3; 211/94

[58] Field of Search ..... 211/1.3, 94, 45, 71, 211/84; 312/245

[56] References Cited

U.S. PATENT DOCUMENTS

| | | | |
|---|---|---|---|
| 3,425,568 | 2/1969 | Albright | 211/94 X |
| 4,457,436 | 7/1984 | Kelley | 211/94 X |
| 4,485,928 | 12/1984 | Staashelm | 211/1.3 X |
| 4,807,764 | 2/1989 | Bellin | 211/94 |
| 4,901,866 | 2/1990 | Barella | 211/1.3 |

*Primary Examiner*—Alvin C. Chin-Shue
*Assistant Examiner*—Sarah L. Purol
*Attorney, Agent, or Firm*—Palmatier, Sjoquist & Helget

[57] ABSTRACT

A panel hanging and storing system with an elongate header bar affixable to a wall surface, the elongate header bar having a hinged elongate bracket which has a flat plate swingable to an upward position against the header, and swingable to a downward position to expose an elongate channel affixed to the plate, the channel having a tackable strip and a raised edge for hanging panels and the like. The panels associated with the invention have hook-shaped hangers affixed along edges, for hanging engagement with the channel. A storage cabinet sized to accept the panels is also affixable to a wall surface, the storage cabinet having a hinged door and a relatively narrow depth for storage of a predetermined number of panels.

10 Claims, 2 Drawing Sheets

HEADER AND PANEL HANGING SYSTEM

BACKGROUND OF THE INVENTION

This invention relates to systems and appliances for improving the productivity and efficiency of office environments; more particularly, the invention relates to a system for hanging display panels and the like, and for storage thereof and concealment of the display arrangement when not in use.

In office and conference room environments, it is common to affix various display panels, bulletin boards, posters and other materials to the wall, for viewing and discussion purposes, and to remove such articles from the wall after use has been concluded. In order to avoid tack holes and other marks from remaining on the walls after the article has been removed, it has been common to utilize porous wall panels, bulletin boards, tacking strips, and other devices which may be permanently mounted in an office or conference room, wherein such devices have a relatively porous surface for affixing push pins thereto. It is therefore simple to affix an article to these surfaces by push-pin pressure, and when the push pins are removed the surface does not retain the objectionable markings. Sometimes the useful features of tack boards and display devices are combined, as for example in the case of a chalkboard which may be permanently affixed to a wall, wherein the chalkboard has an upper edge which is formed of a material which serves as a tacking strip for temporarily affixing push pins thereto. Alternatively, tacking strips have been combined into aluminum frame extrusions, wherein the frame is formed with a projecting lip for hanging articles thereon, wherein the combination tacking strip and frame extrusion are permanently affixed to a wall surface. While such devices have utilitarian value, they generally do not enhance the appearance of an office or conference room decor.

An advantage would be achieved if the utility of such features as tacking strips and extruded wall hanger strips could be applied in a useful form, but could also enhance the room appearance when not in use.

SUMMARY OF THE INVENTION

A system for facilitating the hanging display of graphic materials, panels and the like, including a hinged cover having a hanging strip extrusion affixed thereto, and a decorative molding affixed to the hinge cover, wherein the hinged hanging strip extrusion may be concealed behind the decorative molding when not in use. A storage locker for receiving and storing a plurality of relatively thin panels consisting of graphics material and the like, wherein each panel incorporates a hanging lip for grasping against the extrusion to suspend the panel from the extrusion when in use.

It is the principal object of the present invention to provide a decorative molding for concealably confining an extruded hanging strip for panels and the like.

It is another object of the present invention to provide a decorative storage locker for the storage of panels and the like.

It is an advantage of the present invention to provide a decorative system for an office or conference room wherein a plurality of panels may be concealed while in storage, and a hanging strip may be hingedly opened for suspending the panel while in use.

The foregoing and other objects and advantages will become apparent from the following specification and claims, and with reference to the appended drawings.

DESCRIPTION OF THE PREFERRED EMBODIMENT

Figure 1:
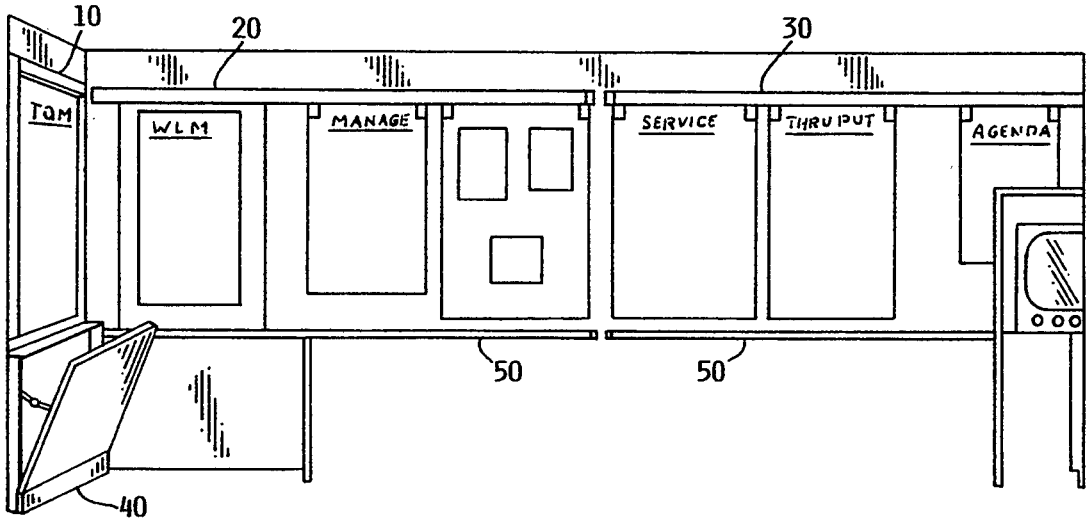
FIG. 1 shows a representative wall surface incorporating the present invention.

Referring first to FIG. 1 there is shown a representative wall space which may form a part of an office or conference room, wherein the invention may be usefully applied. A plurality of decorative rails 10, 20, 30 may be affixed to the wall surface, wherein each rail is constructed of a material such as a fine wood, or a fabric covered wood or plastic, which decoratively enhances the appearance of the office or conference room setting. A storage cabinet 40 may be affixed to one of the walls in the manner shown, wherein the storage cabinet has a relatively small depth dimension and has height and width dimension suitable for storage of the various panels and graphic materials which are illustrated in the drawing. Further decorative rails 50 may be applied to the wall surface to further enhance the appearance of the office or conference room environment. FIG. 1 also shows a plurality of representative hangings, including charts, graphic panels, chalkboards and the like which may be used in conjunction with the invention in the manner to be hereinafter described.

Figure 2:
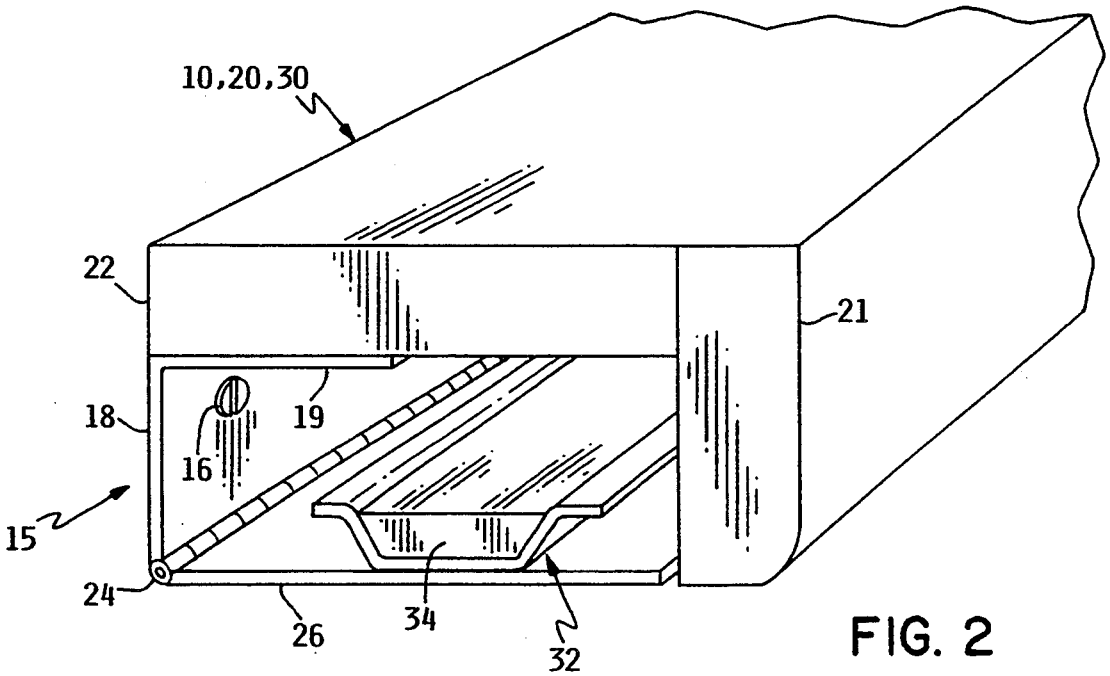
FIG. 2 shows a partial isometric view of the decorative rail and hanging strip.
Figure 3:
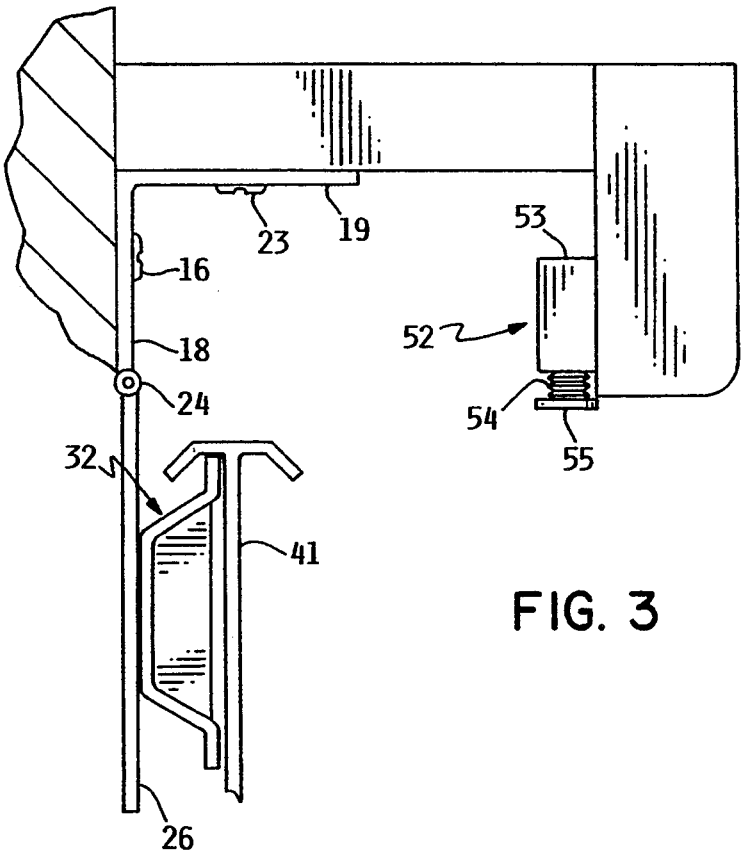
FIG. 3 shows an end view of the decorative rail and hanging strip, in an opened position.

FIG. 2 shows an isometric view of a representative one of the rails 10, 20, 30 in partial isometric view. A hinged bracket 15 may be affixed to a wall surface by a plurality of screws 16 along a vertical surface 18. A right angle bend 19 is affixed to a cover plate 22 by a plurality of further screws 23 (see FIG. 3). An elongated piano hinge 24 forms a part of bracket 15 and a plate 26 is affixed to the piano hinge 24. A hanging strip extrusion 32 is affixed to the plate 26, and a tacking strip 34 may be affixed into a channel in hanging extrusion 32. Tacking strip 34 may be made from cork or equivalent porous material adapted for receiving push pins and the like. A vertical cover board 21 is attached to horizontal cover 22, and extends downwardly at least as far as piano hinge 24. FIG. 2 shows the bracket 15 in the closed position, wherein plate 26 is pivoted upwardly into the recess formed between covers 21 and 22. FIG. 3 shows an end view of the apparatus, wherein bracket 15 is in an opened position. In this position, plate 26 is released from its closed position and pivoted downwardly about hinge 24 to place extrusion 32 into a relatively vertical position. FIG. 3 also shows a typical hanger 41 suspended from a lip of hanger extrusion 32. Hanger 41 preferably has a hook-like end projection for conveniently hooking over the lip of hanger extrusion 32 when it is in the position shown in FIG. 3. FIG. 3 also shows a spring-loaded magnetic latch 52 of the type commonly used as a cabinet door closure. Magnetic latch 52 typically has a latching mechanism within a housing 53, and a magnet which projects from housing 53 via a compression spring 54. When the hinge 15 is swung upwardly into a closure position the upper surface of plate 26 contacts magnet 55, and a further upward motion causes magnet 55 to move against the force of spring 54 to engage the latching mechanism in housing 53. This latches the magnet 55 upwardly into a latched relationship, and magnet 55 securely holds against the upper surface of metal plate 26 to retain plate 26 in a relatively horizontal position a shown in FIG. 2. When a further upward force is applied against plate 26, magnetic latch 52 releases and plate 26 is then permitted to fall downwardly and pivot about hinge 24. In this manner, bracket 15 may be hingedly locked into a closure position as illustrated in FIG. 2, or opened into a suspended and open position as shown in FIG. 3.

Figure 4:
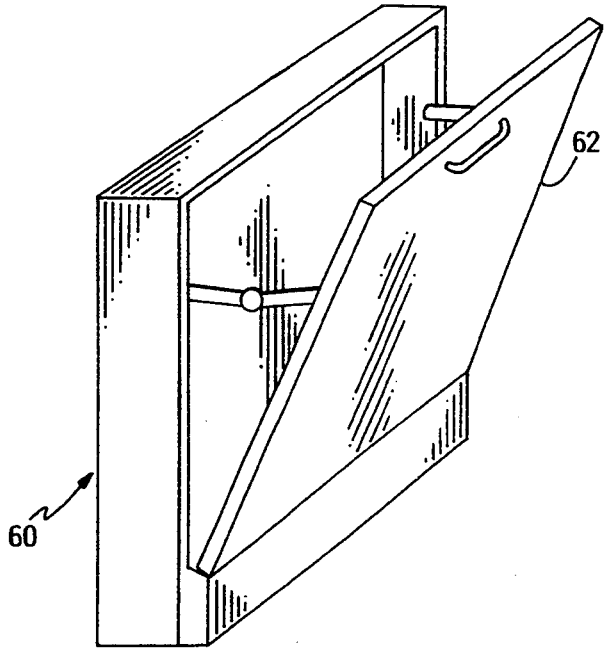
FIG. 4 shows an isometric view of the storage cabinet incorporated with the present invention.
Figure 5:
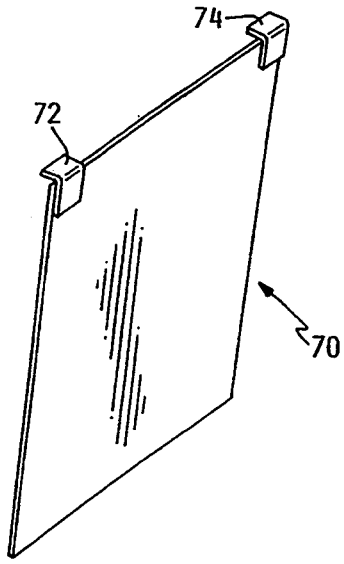
FIG. 5 shows an isometric view of a representative panel of the type used with the invention.

FIG. 4 shows a storage cabinet 60 for use with the present invention. Storage cabinet 60 is preferably constructed of a fine grain wood or other decorative material so as to create a pleasing appearance in the office or conference room environment. Storage cabinet 60 has a relatively small depth dimension, and a height and width dimension sufficiently sized to accommodate the hangable panels which are to be suspended from the hanging extrusion 32. A representative hanging panel 70 is shown in FIG. 5, with a pair of hanging hooks 72, 74 affixed thereto. Storage cabinet 60 has a swingable door 62 which may be opened to permit storage of panel 70 and the like. A plurality of panels 70 may be conveniently stored inside of cabinet 60, and may be retrieved for subsequent use.

In operation, the decorative rails 10, 20, 30 are preferably maintained with hinge 15 in the latched position as shown in FIG. 2, when the structure is not in use. This presents a pleasing overall appearance wherein all of the hanging mechanisms are entirely concealed from view, and the rails form a decorative part of the room environment. At the time it is desired to hang a panel or other object from the hanging rails the plate 26 is forced upwardly by an incremental distance, thereby releasing the magnetic latch mechanism and permitting the hinge to open and permitting plate 26 to become suspended vertically downwardly. Various panels and charts and display graphics may be then retrieved from storage cabinet 60 and suspended along the extruded hanging rail 32 at convenient positions. After use of the various panels has been concluded they may be retrieved from the hanging extrusion and returned to their storage position within cabinet 60.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for hanging panels and the like, comprising:

a) an elongated L-shaped rail having a horizontal member and a vertical member, the vertical member having a lower edge a predetermined distance from said horizontal member;

b) an elongated hinged bracket comprising an L-shaped plate hingedly connected to a flat plate, said L-shaped plate being affixed to said horizontal member and extending from said horizontal member a distance no greater than said predetermined distance, and said flat plate being swingable to proximately said vertical member;

c) an extruded elongate channel affixed to said flat plate, said channel having raised edges therealong; and d) means for releasably attaching said flat plate to said vertical member, whereby said channel is confined within the space defined by said L-shaped rail and said hinged bracket.

2. The apparatus of claim 1, wherein said flat plate is metal and said means for releasably attaching further comprises a magnetic latch.

3. The apparatus of claim 2, wherein said elongate channel further comprises a center section having a tacking strip affixed thereto.

4. The apparatus of claim 3, further comprising means for affixing said L-shaped plate to a wall surface.

5. The apparatus of claim 4, further comprising an elongate piano hinge connecting said L-shaped plate to said flat plate.

6. The apparatus of claim 5, further comprising means for hanging a panel over one of said elongate channel raised edges.

7. A panel hanging and storage system, comprising:

a) an elongate header rail horizontally affixable to a wall surface, comprising an L-shaped elongate decorative member and a hinged bracket affixed to said decorative member, said hinged bracket having an elongate flat surface which is downwardly pivotable away from said decorative member, said flat surface having an elongate channel member affixed thereto said channel member having at least one raised edge;

b) a plurality of panels, each panel comprising at least one hook-shaped hanger affixed along an edge, said hanger being engageable to said channel member at least one raised edge;

c) at least one storage cabinet affixable to said wall surface, said storage cabinet having a hinged door and having height and width dimensions sufficient to receive said panels.

8. The apparatus of claim 7, wherein said channel member further comprises an elongate tacking surface affixed thereto.

9. The apparatus of claim 8, wherein said elongate flat surface further comprises metal, and further comprising a magnetic latching means affixed to said decorative member and positioned to hold said flat surface in upwardly pivotal position against said magnetic latching means.

10. The apparatus of claim 9, wherein said hinged bracket further comprises means for affixing to said wall surface.

* * * * *